United States Patent [19]

Klevstad

[11] 4,426,071

[45] Jan. 17, 1984

[54] LEG SUPPORTING DEVICE FOR OBSTETRICAL TABLES

[75] Inventor: Sven M. Klevstad, Solna, Sweden

[73] Assignee: Landstingens Inkopscentral, Lic, Ekonomisk Forening, Solna, Sweden

[21] Appl. No.: 347,446

[22] Filed: Feb. 9, 1982

[30] Foreign Application Priority Data

Feb. 13, 1981 [SE] Sweden ..... 8101003

[51] Int. Cl.[3] ..... A61G 13/00

[52] U.S. Cl. ..... 269/325; 269/328

[58] Field of Search ..... 403/61, 187; 269/328, 269/45, 325, 76–78

[56] References Cited

U.S. PATENT DOCUMENTS 2,067,891 1/1937 Comper .
2,614,558 10/1952 Lovell ..... 269/328
2,757,058 7/1956 Broesel ..... 269/328

FOREIGN PATENT DOCUMENTS 823556 9/1969 Canada ..... 269/328
342549 2/1972 Sweden .
355723 5/1973 Sweden .

*Primary Examiner*—Robert C. Watson
*Attorney, Agent, or Firm*—Young & Thompson

[57] ABSTRACT

An obstetrical table has on each side a leg supporting device, each including a foot rest and a thigh support which are adjustable individually and lockable in any desired position relative to a vertical bushing which is rotatably mounted in a bracket fastened to the side of the frame of the table. The foot rest and thigh support connected to the bushing may then be swung about a vertical axis as a unit for further adjustments.

1 Claim, 7 Drawing Figures

LEG SUPPORTING DEVICE FOR OBSTETRICAL TABLES

The present invention relates to obstetrical tables and more particularly to a leg supporting device for such tables.

Modern obstetrical tables can be adjusted to a number of positions to support the patient in a lying position, a sitting position or any intermediate position. To enable this the table has a back portion which may be swung from a horizontal lying position to an upright sitting position. The table has further an intermediate seat portion which is secured to the frame of the table and which forms a seat for the patient. Furthermore, the table has a leg supporting portion which may be placed in a position flush with the seat portion and which may be lowered and inserted partially or completely to a position under the seat portion and the back portion.

At each side of the table frame there is provided an attachment head for an adjustable shaft supporting a foot rest at its end. The shaft is displaceable in the head for adjustment to various leg lengths and the head enables further any desired vertical angular position of the shaft to adjust the height position of the foot rest. An obstetrical table of this kind is disclosed in the Swedish Pat. Nos. 342,549 and 355,723. However, the possibilities of adjusting the position of the foot rests are rather limited since the foot rest supporting shafts can only be angularly adjusted in one plane only. Furthermore, there are no supports for the thighs.

Further, it is also known from U.S. Pat. Nos. 1,622,313, 2,067,891 and 2,306,031 to have the foot rests combined with thigh supports. However, the possibilities of adjusting the known leg supporting devices are insufficient for various desired positions of the patient.

The object of the invention is therefore to provide a leg supporting device for obstetrical tables including a pair of foot rests and a pair of thigh supports which may be adjusted individually and as a unit to a greater extent than hitherto possible with known devices.

This is attained with a leg supporting device according to the invention as defined hereinafter.

A suitable embodiment of the leg supporting device according to the invention is diagrammatically shown in the accompanying drawings.

Figure 7:
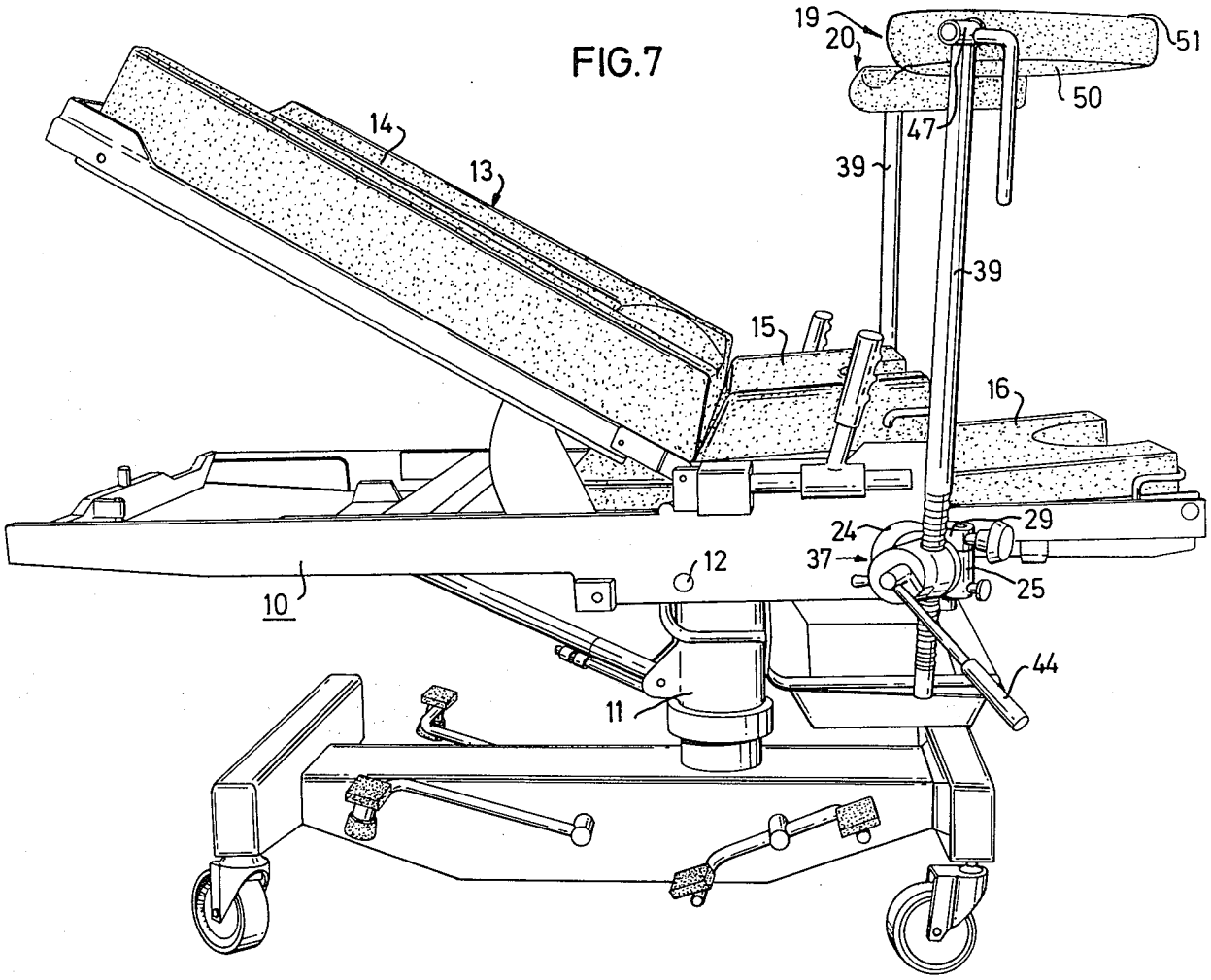
FIG. 7 is a side view of the table in a position where the patient has the thighs substantially vertical and the lower legs supported by inverted foot rests.

As shown in FIG. 7, the table frame 10 is carried by a vertically adjustable column 11 and is tiltable about an axis 12.

The table 13 comprises three separate portions, namely a back portion 14 adjustable to various angular positions, an intermediate seat portion 15 secured to the frame 10, and a leg portion 16 which may be placed in a position flush with the seat portion 15 or lowered and partially or completely inserted to a position under the seat portion 15 in a manner known per se.

At both sides of the frame 10 is provided a leg supporting device 17,18 which includes an adjustable foot rest 19,20 and an adjustable thigh support 21,22. Only the right hand device 17 will be described in detail in the following.

Figure 4:
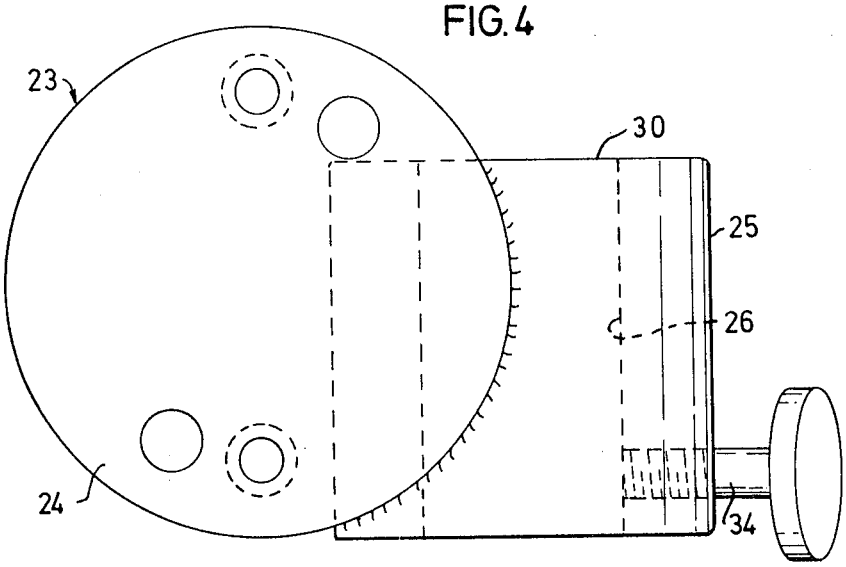
FIG. 4 is a detail front view of the bracket member secured to the frame of the table and rotatably supporting the attachment head.
Figure 5:
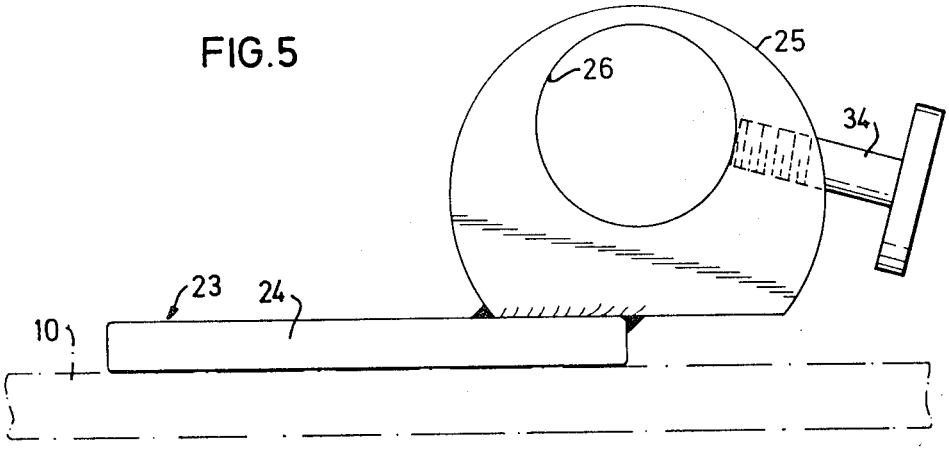
FIG. 5 is a plan view of the bracket member in FIG. 4.
Figure 6:
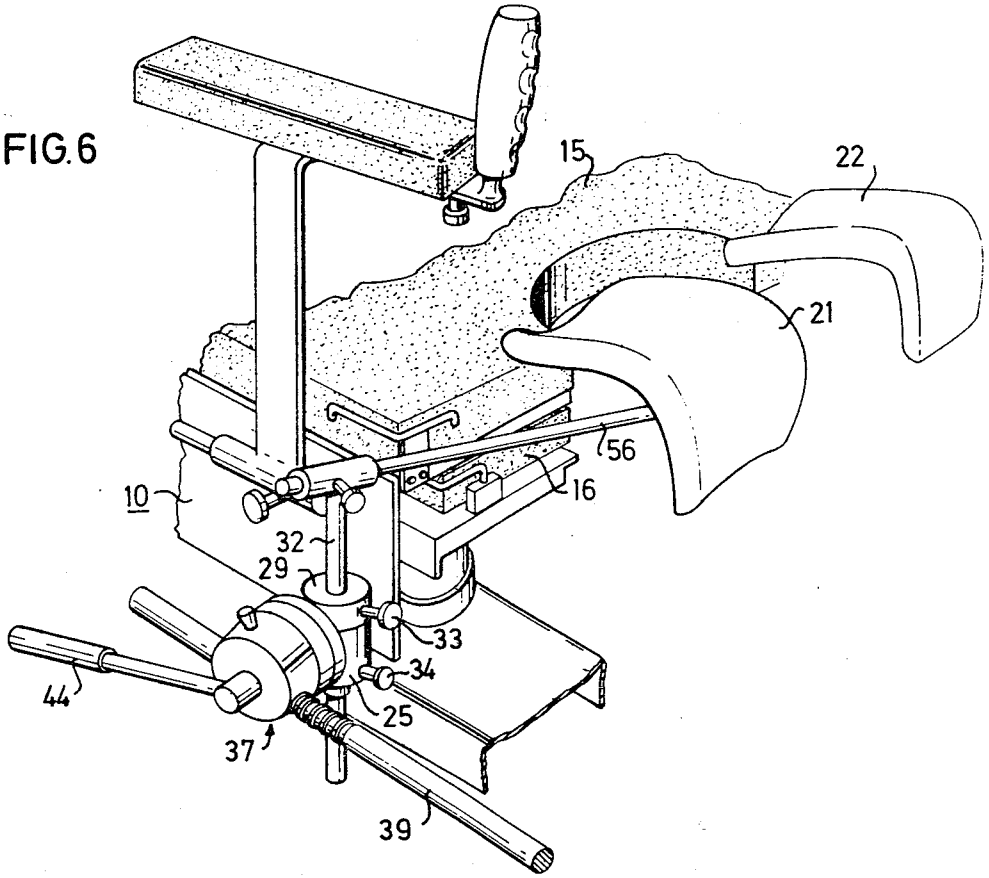
FIG. 6 is a perspective view of the resting position of the thigh supports, the foot rests being in a position to support the patient's feet.

Secured by bolts to the side of the frame 10 is a bracket member 23 shown in detail in FIGS. 4 and 5.

Figure 3:
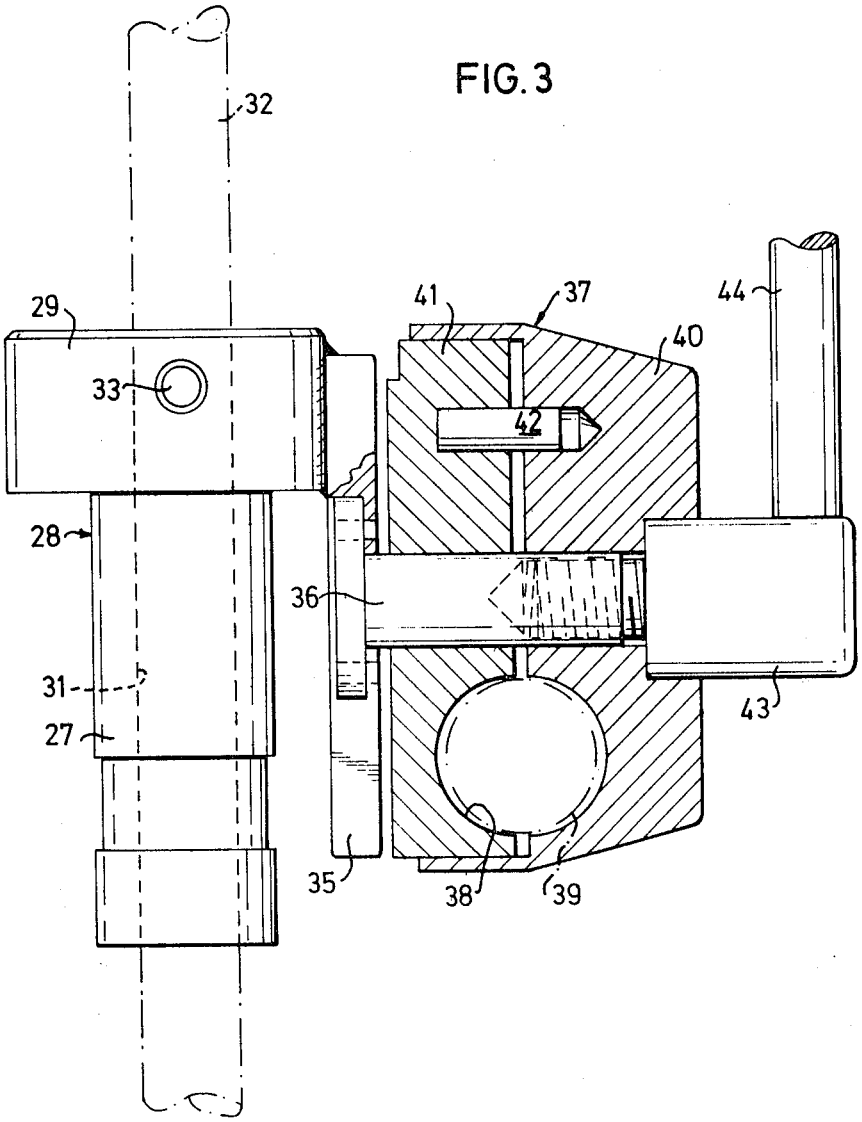
FIG. 3 is a sectional view of the rotatable attachment head supporting the foot rest.

The bracket member 23 has a mounting plate 24 bolted to the frame 10 and is provided with a socket 25 having a vertical cylindrical bore 26 for receiving the cylindrical portion 27 (FIG. 3) of a bushing 28 which has a flange 29 resting on the top 30 (FIG. 4) of the socket 25.

The cylindrical bore 31 of the bushing guides a cylindrical vertical shaft 32 which may be adjusted to any desired vertical and angular position respectively in the bushing and may be locked thereto by any suitable means such as a locking bolt 33.

Similarly, the bushing 28 may be locked in the socket 25 by any suitable means such as a locking bolt 34.

A circular plate 35 is welded to the flange 29 of the bushing 28 and is provided with a horizontal journal 36 which carries a rotatable attachment head 37.

The head has a cylindrical bore 38 extending at right angles to the journal 36 for guiding a shaft 39 which may be locked in the bore. To this end the head comprises two discs or blocks 40,41 rotatably mounted on the pin 36 but locked against relative rotation by a pin 42.

The two blocks are formed each with a half of the bore 38, and by means of a threaded pressure member 43 operated by a lever 44, the two blocks may be pressed together and against the plate 35 to clamp the shaft 39 and lock the same as well as locking the head 37 against rotation.

In the embodiment shown, the shaft 39 has annular grooves 45 into which a spring actuated locking pin 46 may engage to lock the shaft against axial displacement.

The shaft 39 carries at its forward end a transverse sleeve 47 in which a shaft 48 is rotatably and displaceably mounted and can be locked by means of a locking screw operated by a lever 49. The foot rest 19 can accordingly be adjusted to various angular positions as well as axial positions relative to the sleeve 47.

Figure 1:
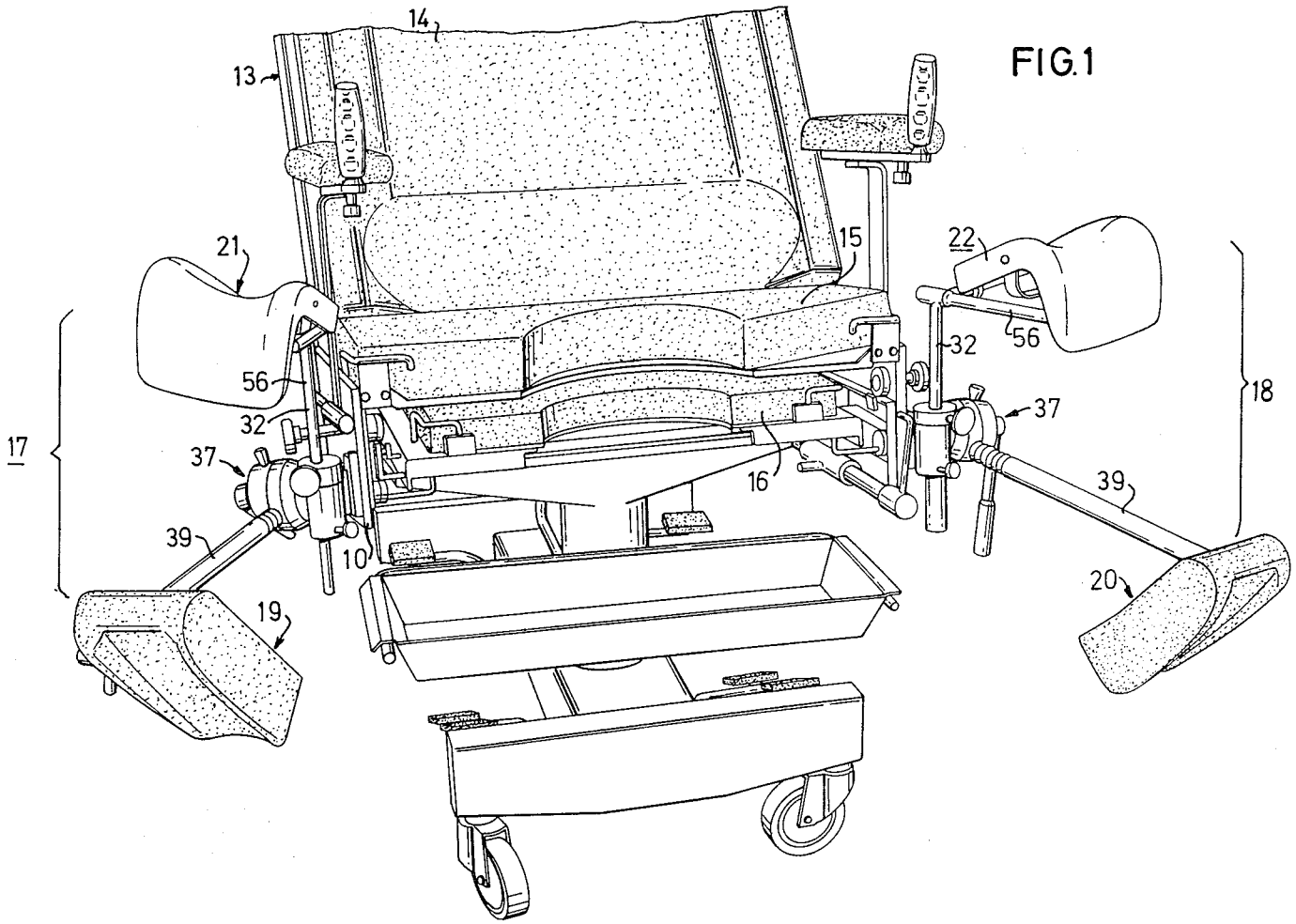
FIG. 1 is a diagrammatic perspective view of the table adjusted for a sitting position of the patient with the legs supported on a thigh support and a foot rest at either side of the table.
Figure 2:
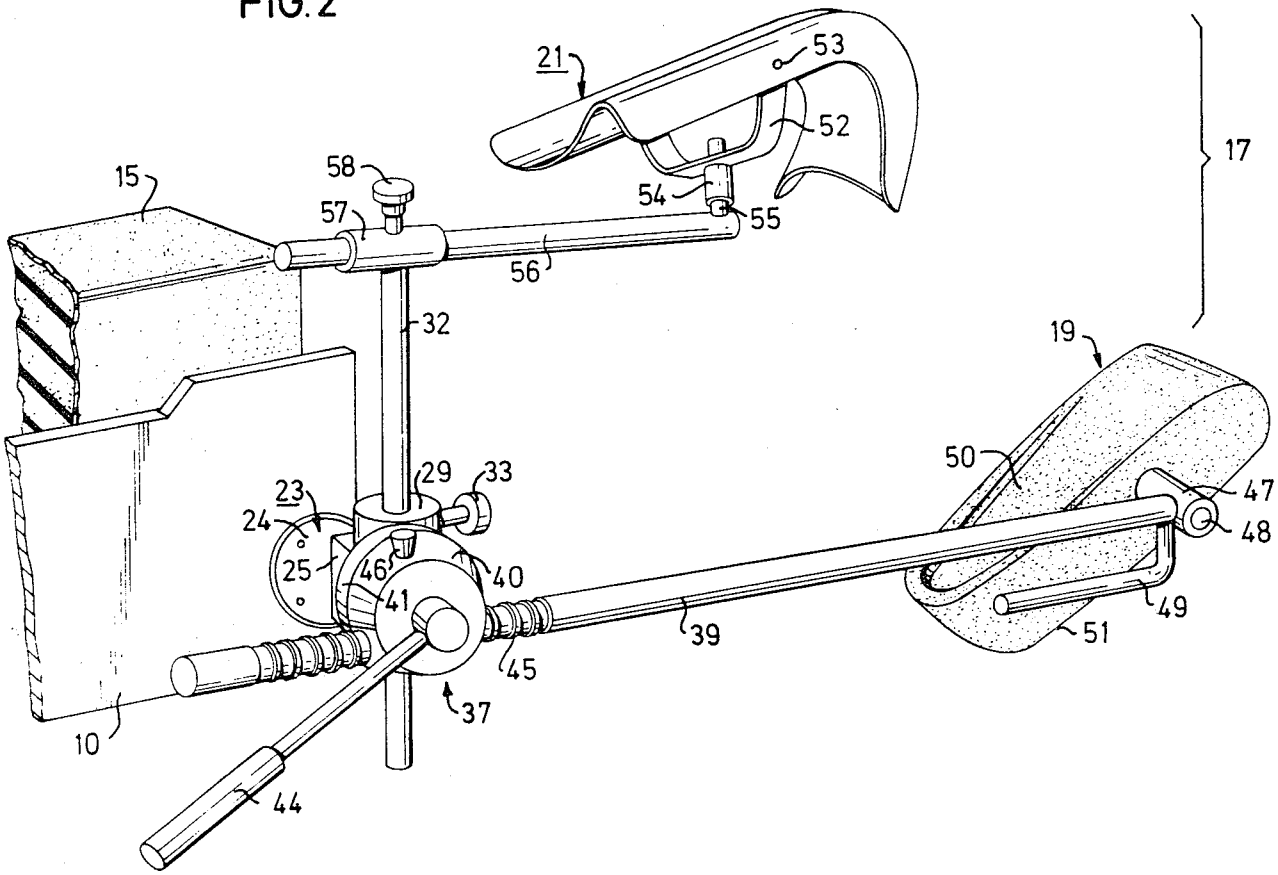
FIG. 2 is a partial perspective view of the leg supporting device at the right hand side of the table in FIG. 1.

The foot rest 19 has its one side shaped to form a foot rest surface, whereas its opposite side (bottom side in FIG. 2) may be shaped to form a support surface 51 for the lower leg of the patient's legs when the patient is lying with the thighs substantially vertical as illustrated in FIG. 7, in which the shafts 32 with the thigh supports 21 and 22, respectively, have been removed. In FIG. 7, the foot rests 19,20 may be swung inwards or outwards by swinging the head 37 about the axis of the bore 26 in the socket 25.

The thigh support 21 is pivotally mounted on a holder 52 (FIG. 2) to pivot about a transverse axis 53, and the holder is rotatably mounted to rotate about an axis 54 defined by a journal 55 mounted at right angles to a carrying arm 56 which is displaceably mounted in sleeve 57 secured to the top end of shaft 32 at right angles to the same. A locking screw 58 is used to lock the arm 56 in the sleeve 57.

The leg supporting devices 17,18 according to the invention are particularly useful when the doctor assisting at the birth is sitting in front of the mother lying or sitting on the table with the leg portion 16 partially or completely retracted to a position under the seat portion 15.

The mother's legs can be comfortably supported in any desired position by adjusting the foot rests and the thigh supports to the desired positions. Thereafter, each bushing 28 will support a locked unit having a foot rest and a thigh support, whereafter this unit may be swung inwardly or outwardly to obtain a further adjustment of the angle between the mother's legs without any need of individual readjustments of the foot rest and the thigh support, respectively.

I claim:

1. In an obstetrical table having a back portion, a seat portion, a leg portion, means for adjusting the back portion to any desired angular position, means for adjusting the leg portion from a position flush with the seat portion to a lowered position from which the leg portion may be inserted at least partially under the seat portion, and a leg-supporting device secured to the table at each side thereof and including a foot rest and a thigh support; the improvement comprising a bracket secured to each side of the table for carrying the leg-supporting devices, the bracket having a vertical bore therethrough, a guide bushing rotatably supported in the bore, means selectively to lock the guide bushing in any desired rotated position within the bore, a horizontal journal carried by the bushing, a head supported for rotation on the journal, means selectively to lock the head in any rotated position on the journal, the head having a bore therein substantially at right angles to the journal, a shaft disposed in the latter bore, means selectively to lock the shaft in any desired position of adjustment in the bore of the head, a foot rest mounted on the end of the shaft for swinging movement about an axis transverse to the shaft, means for selectively locking the foot rest in any adjusted position of rotation about the last-named axis, a vertical shaft carried for rotation by the bushing, means selectively to lock the vertical shaft in any rotated position relative to the bushing, a horizontal sleeve carried by the vertical shaft at its upper end, an arm slidable in the sleeve, means selectively to lock the arm in any slid position in the sleeve, the arm at its end having a holder, a thigh support carried by the holder, and means mounting the thigh support on the holder for swinging movement about an axis transverse to the arm.

* * * * *